US012698018B2

(12) United States Patent
Sauter et al.

(10) Patent No.: US 12,698,018 B2
(45) Date of Patent: Aug. 4, 2026

(54) RAILWAY SYSTEM WITH DIAGNOSTIC SYSTEM AND METHOD FOR OPERATING SAME

(71) Applicant: Siemens Mobility GmbH, Munich (DE)

(72) Inventors: Witali Sauter, Braunschweig (DE); Karsten Blum, Braunschweig (DE)

(73) Assignee: Siemens Mobility GmbH, Munich (DE)

( * ) Notice: Subject to any disclaimer, the term of this patent is extended or adjusted under 35 U.S.C. 154(b) by 832 days.

(21) Appl. No.: 17/921,382

(22) PCT Filed: Apr. 6, 2021

(86) PCT No.: PCT/EP2021/058898
§ 371 (c)(1),
(2) Date: Oct. 26, 2022

(87) PCT Pub. No.: WO2021/219327
PCT Pub. Date: Nov. 4, 2021

(65) Prior Publication Data

US 2023/0182787 A1 Jun. 15, 2023

(30) Foreign Application Priority Data

Apr. 28, 2020 (DE) ..... 10 2020 205 348.0

(51) Int. Cl.
*B61K 9/08* (2006.01)

(52) U.S. Cl.
CPC ..... *B61K 9/08* (2013.01)

(58) Field of Classification Search
CPC ..... B61K 9/08; B61L 27/53
See application file for complete search history.

(56) References Cited

U.S. PATENT DOCUMENTS 6,789,111 B1 * 9/2004 Brockway ..... H04L 69/329 710/72
10,167,003 B1 * 1/2019 Bilodeau ..... B61L 3/16
2013/0304896 A1 * 11/2013 Collins ..... H04L 67/04 709/224
2018/0091510 A1 * 3/2018 Erez ..... H04L 63/0227
(Continued)

FOREIGN PATENT DOCUMENTS

DE 102013217324 A1 3/2015

OTHER PUBLICATIONS

Cantone, EP-3290289, English Translation (Year: 2018).*
(Continued)

*Primary Examiner* — Michael J Dalbo
(74) *Attorney, Agent, or Firm* — Laurence A. Greenberg; Werner H. Stemer; Ralph E. Locher

(57) ABSTRACT

A railway system has a diagnostic system for monitoring railway components of the railway system and at least one railway component connected to the diagnostic system. The railway component is configured to automatically transmit a self-describing data set to the diagnostic system and/or allow the diagnostic system to request such a data set as part of a plug-and-play process upon being connected. The diagnostic system is configured to receive the data set from the railway component and to integrate the railway component into the remaining diagnostic operation on the basis of the data set.

16 Claims, 8 Drawing Sheets

(56) References Cited

U.S. PATENT DOCUMENTS

| | | | | |
|---|---|---|---|---|
| 2018/0120279 | A1* | 5/2018 | Yi | G01N 33/0075 |
| 2020/0079405 | A1 | 3/2020 | Martell et al. | |
| 2020/0287627 | A1* | 9/2020 | Johnson | H04B 10/27 |
| 2020/0300832 | A1* | 9/2020 | Drewett | G01N 33/383 |

OTHER PUBLICATIONS

Manfred Arndt: "Modular concept of diagnostic and monitoring technologies", Signal+ Wire,, vol. 107, No. 6, Jun. 1, 2015 (Jun. 1, 2015), pp. 38-45, XP001595236.

Ricarda Weber et al: "Überwachung sicherheitskritischer Bahnnetzwerke mittels eines Einweg-Gateways—Monitoring safety-critical railway networks using unidirectional gateways", Signal and Wire:: Signalling & Datacommunication, vol. 110, No. 9, Sep. 7, 2018 (Sep. 7, 2018), pp. 21-28, XP055509675, DE ISSN: 0037-4997.

* cited by examiner

RAILWAY SYSTEM WITH DIAGNOSTIC SYSTEM AND METHOD FOR OPERATING SAME

The invention relates to railway systems which are equipped with a diagnostic system for monitoring railway components of the railway system.

FIELD AND BACKGROUND OF THE INVENTION

When new railway components (system or equipment parts) that require diagnosis are introduced into diagnostic systems for monitoring railway components of a railway system, said new components must be made known to the diagnostic system so that they can be included in the diagnosis. Specifically, the diagnostic system must replicate both the railway component as such (i.e. its construction type) and the actual entity (i.e. in the form of component-specific identification data such as e.g. serial number, individual address information for communication, etc.) as a diagnostic object in the memory, and must know both the properties and the methods/rules for the respective diagnostic object.

The data required for the diagnosis forms a data set which is specific to the railway component. At present, the input of the data sets usually consists in said data sets being input into the diagnostic system as project planning data in the course of programming, configuration, or in the course of system project planning.

The input of data sets into diagnostic systems today is temporally independent of the connection of the respective railway components to the railway system. Consequently, the project planning data or data sets might not correspond to the connected railway components. Exemplary scenarios of this are as follows:

- One or more railway components were added to the railway system without amending or updating the project planning data or data sets in the diagnostic system accordingly.
- Data sets or project planning data do not correspond to the current railway system because errors were made during project planning, e.g., railway components were omitted.

In the case of conversion works in particular, the project planning or configuration of the diagnostic system must be updated following the introduction of one or more new railway components into the railway system that is to be diagnosed, and this can lead to problems of consistency between the actual railway system and the diagnostic system. Costly regression tests are often also necessary in order to verify that the changes introduced will not affect the project planning that is already in place (so-called change effect analysis).

SUMMARY OF THE INVENTION

The object of the invention is to improve a railway system with regard to simple configuration of the diagnostic system.

This object is inventively achieved by a railway system as claimed. Advantageous embodiments of the inventive railway system are specified in the dependent claims.

Accordingly, provision is made according to the invention for the railway component to be designed to autonomously transmit a self-describing data set and/or allow the diagnostic system to request such a data set as part of a plug-and-play method following connection to the diagnostic system, and the diagnostic system is designed to receive the data set from the railway component and to integrate the railway component into the further diagnostic operation on the basis of the data set.

It is considered an important advantage of the inventive railway system that the inventively provided diagnostic system ensures automatic (i.e., autonomous) reconfiguration or automatic adaptation of the diagnostics to the latest or the new system situation, i.e., without the need for manual intervention by maintenance personnel, when new railway components are connected to the diagnostic system. In other words, there is no need for project replanning, let alone new integration tests, change effect analyses or regression tests, following the addition of new railway components.

The diagnostic system is preferably designed in such a way that it receives or can receive the data set from the railway component, and integrates or can integrate the railway component into the further diagnostic operation, while live diagnostic operation is taking place in relation to other railway components. In other words, the integration of new railway components preferably takes place during the diagnostic operation of the other railway components that are already integrated.

In an advantageous variant, provision is made for the railway component to have a first component part which meets or exceeds a predetermined safety standard, and a second component part which does not meet the cited safety standard, and for the data set to be stored in the second component part.

In the last-cited variant, it is advantageous for the second component part to autonomously transmit the data set to the diagnostic system following connection to the diagnostic system.

Alternatively or additionally, provision can advantageously be made for the second component part to enable the diagnostic system to request the data set following connection to the diagnostic system.

With regard to sealing off the cited first "safety-relevant" component part against unauthorized access from the outside and/or with regard to so-called absence of interaction, it is considered advantageous for the first and the second component parts to be connected via a data diode which allows a data flow exclusively from the first component part into the second component part, and for information relating to the first component part, which must be transmitted to the diagnostic system for the purpose of diagnosis, to be transferred via the data diode to the second component part and from there to the diagnostic system.

Alternatively or additionally, provision can be made for the railway component to be connected to the diagnostic system via a data diode which allows a data flow exclusively from the railway component to the diagnostic system, and for the railway component, following connection to the diagnostic system, autonomously to transmit the data set and subsequently information which must be transmitted to the diagnostic system for the purpose of diagnosis, via the data diode to the diagnostic system as part of the plug-and-play method.

The railway component or at least one of the railway components is preferably a set of points which, as information that must be transmitted to the diagnostic system for the purpose of diagnosis, transmits current values and/or point throwing times to the diagnostic system.

The railway component or at least one of the railway components is preferably a signal device which, as information that must be transmitted to the diagnostic system for the purpose of diagnosis, transmits current values to the diagnostic system.

The railway component or at least one of the railway components is preferably an interlocking tower which, as information that must be transmitted to the diagnostic system for the purpose of diagnosis, transmits interlocking tower data to the diagnostic system.

The railway component or at least one of the railway components is preferably an axle counter which, as information that must be transmitted to the diagnostic system for the purpose of diagnosis, transmits axle counter data to the diagnostic system.

The railway component or at least one of the railway components is preferably a vehicle control center (in particular an ETCS vehicle control center) which, as information that must be transmitted to the diagnostic system for the purpose of diagnosis, transmits vehicle control center data to the diagnostic system.

In a particularly preferred embodiment, the data set which arrives at the diagnostic system as part of the plug-and-play method following connection to the diagnostic system is a complete data set in the sense that by itself it completely describes the railway component and itself alone enables the subsequent diagnosis by the diagnostic system.

Alternatively, provision can be made for the data set which arrives at the diagnostic system, as part of the plug-and-play method following connection to the diagnostic system, to merely identify the railway components, such that the diagnostic system can expand the data set received from the railway component by adding supplementary component data from another source, e.g. a central database, thus forming a complete data set which completely describes the railway component and enables the subsequent diagnosis by the diagnostic system.

In order that the diagnostic system can diagnose railway components in a particularly simple manner, e.g. store and evaluate the status data of the railway component, the data set which is transmitted from the railway components to the diagnostic system or the subsequently expanded data set preferably comprises at least the following information:

- an unambiguous identification of the respective railway component,
- a data structure of the information or diagnostic data of the railway component,
- rules which could lead to a diagnostic result, and/or
- further component-specific information, e.g. alarm reports in different languages, symbols which graphically represent the components, etc.

The diagnostic system can advantageously be realized as a cloud application or as a software module of a computing system of the railway system.

The invention further relates to a railway component for a railway system. According to the invention, said railway component is so designed as to autonomously transmit a self-describing data set and/or allow the diagnostic system to request such a data set as part of a plug-and-play method following connection to a diagnostic system of the railway system.

Concerning the advantages of the inventive railway component and concerning advantageous embodiments of the inventive railway component, reference is made to the foregoing explanations relating to the inventive railway system and advantageous embodiments thereof.

A subsequent diagnosis is preferably enabled by the data set itself, or at least after the addition of supplementary component data from another source.

In an advantageous embodiment, the railway component has a computing device which is programmed in software or in hardware to autonomously transmit a self-describing data set and/or allow the diagnostic system to request such a data set as part of a plug-and-play method following connection to a diagnostic system of the railway system.

The invention further relates to a diagnostic system for a railway system. According to the invention, said diagnostic system is so designed as to receive a data set from a railway component which is newly connected to the diagnostic system, and integrate said railway component into the further diagnostic operation on the basis of the data set.

Concerning the advantages of the inventive diagnostic system and concerning advantageous embodiments of the inventive diagnostic system, reference is made to the foregoing explanations relating to the inventive railway system and advantageous embodiments thereof.

It is advantageous if the diagnostic system has a computing device which is programmed in software or in hardware to receive a data set from a railway component which is newly connected to the diagnostic system, and integrate said railway component into the further diagnostic operation on the basis of the data set.

The invention further relates to a method for operating a railway system which has a diagnostic system for monitoring railway components of the railway system.

According to the inventive method, following connection of a railway component to the diagnostic system, the railway component autonomously transmits a self-describing data set and/or allows the diagnostic system to request such a data set as part of a plug-and-play method, and the diagnostic system receives the data set from the railway component and integrates the railway component into the further diagnostic operation on the basis of the data set.

BRIEF DESCRIPTION OF THE FIGURES

The invention is explained in greater detail below with reference to exemplary embodiments, in which by way of example.

The same reference signs are used for any identical or comparable components in the figures.

DETAILED DESCRIPTION OF THE INVENTION

Figure 1:
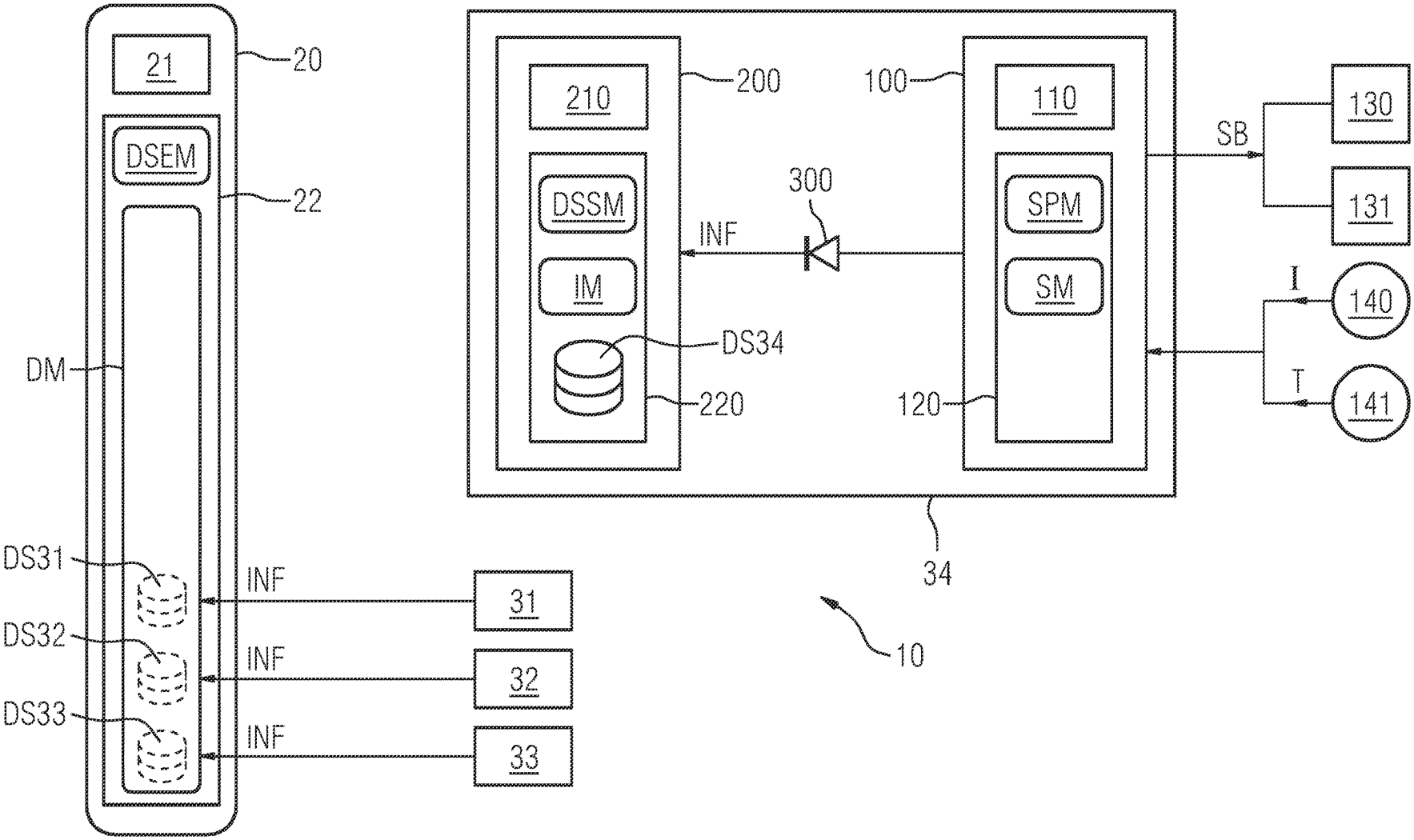
FIG. 1 shows elements of a first exemplary embodiment of a railway system which is equipped with a diagnostic system, specifically before the connection of a new railway component, wherein said new railway component has a safety-relevant component part and a not-safety-relevant component part.

FIG. 1 shows an exemplary embodiment of a railway system 10 which is equipped with a diagnostic system 20.

The diagnostic system 20 comprises a computing device 21 which interacts with a memory 22. Stored in the memory 22 is a diagnostic module DM which enables a diagnosis of railway components that are connected to the diagnostic system 20.

In the exemplary embodiment according to FIG. 1, three railway components are connected to the diagnostic system 20, specifically a signal device 31, an axle counter 32 and an interlocking tower 33. The three railway components 31, 32 and 33 each transmit information INF to a diagnostic module of the diagnostic system 20, on the basis of which a diagnosis of the respective component will take place.

In order to enable the diagnostic module DM to perform a component-specific diagnosis, an associated data set DS31, DS32 and DS33 is stored in the diagnostic module DM for each of the respective connected railway components, i.e. the signal device 31, the axle counter 32 and the interlocking tower 33. In this case, the data set DS31 relates to a diagnosis of the signal device 31, the data set DS32 to a diagnosis of the axle counter 32, and the data set DS33 to a diagnosis of the interlocking tower 33.

Also shown in FIG. 1 is a further railway component, which can be a set of points 34, for example. The set of points 34 comprises a first "safety-relevant" component part 100, which meets or exceeds a predetermined safety standard such as e.g. the safety standard SIL 4.

The first component part 100 comprises a computing device 110 and a memory 120. Stored in the memory 120 is a control program module SPM, which enables operation or interaction with connected devices.

In the exemplary embodiment according to FIG. 1, an actuator 130, which can be e.g. a point machine for the set of points 34, is connected to the first component part 100 or the control program module SPM. The actuator 130 is activated by means of control commands SB from the first component part 100 or the control program module SPM thereof.

In addition to the actuator 130, further actuators, of which one is shown by way of example in FIG. 1 and is identified there by the reference sign 131, can be connected to the first component part 100 or the control program module SPM thereof. The activation of the one or more further actuators 131 can be or is likewise effected by means of control commands SB from the control program module SPM.

In the exemplary embodiment according to FIG. 1, sensors 140 and 141 are also connected to the first component part 100. The sensor 140 can be a current sensor, for example, which captures the current flow when operating the set of points 34 and transmits the corresponding current values I to the first component part 100, e.g. in the form of maximum values or in the form of the total current flow.

The sensor 141 can be a timer, for example, which captures the throwing time of the set of points 34 when they are switched and transmits a corresponding throwing time value T to the first component part 100.

The control of the actuators 130 and 131 by the control program module SPM can advantageously be based on the measurement results or signals from the connected sensors 140 and 141, and from further sensors not shown in FIG. 1 if applicable.

Also stored in the memory 120 of the first component part 100 is a sending module SM which, when executed by the computing device 110 of the first component part 100, forms a sending device. The sending module SM will send the signals of the connected sensors 140 and 141 in processed or unprocessed form as information INF to a second component part 200 of the set of points 34.

In this case, the transmission of the information INF takes place via a data diode 300, which ensures an absence of interaction between the two component parts 100 and 200 and prevents access to the first component part 100 from the second component part 200.

Unlike the first component part 100, the second component part 200 is e.g. not "safety-relevant", since it does not itself meet the predetermined safety standard which is met or exceeded by the first component part 100.

The second component part 200 comprises a computing device 210 and a memory 220. Stored in the memory 220 are an information transfer module IM, a data set DS34 and a data set sending module DSSM.

In FIG. 1, the set of points 34 is not yet connected to the diagnostic system 20 and therefore the diagnostic system 20 or the diagnostic module DM thereof is not able to take the set of points 34 into account as part of its diagnosis.

Figure 2:
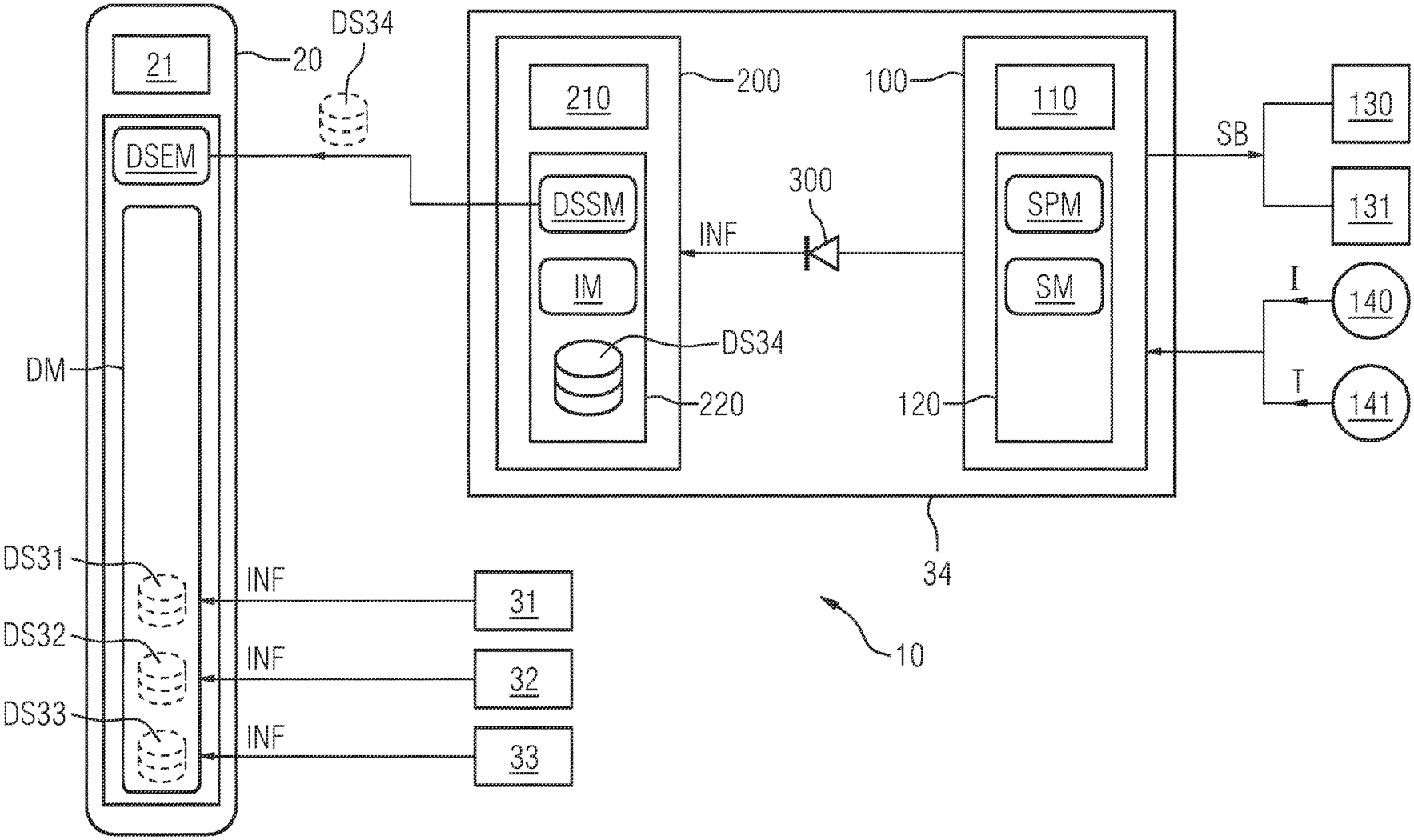
FIG. 2 shows the railway system according to FIG. 1 following connection of the new railway component and during the plug-and-play reconfiguration of the diagnostic system.

In order to integrate the set of points 34 into the diagnosis of the diagnostic system 20, it is merely necessary in the exemplary embodiment according to FIG. 1 to connect the set of points 34 to the diagnostic system 20, since following such a connection the diagnostic system 20 or the diagnostic module DM is automatically extended as part of a plug-and-play method for the purpose of integrating the set of points 34. This is explained in greater detail by way of example in the following:

FIG. 2 shows the arrangement as per FIG. 1 after the set of points 34 has been connected to the diagnostic system 20. Following such a connection and the establishment of a data connection to the diagnostic system 20, the data set sending module DSSM of the second component part 200 of the set of points 34 will autonomously, or alternatively in response to a corresponding prompt from the diagnostic system 20, transmit the data set DS34 which is stored in the memory 220 to the diagnostic system 20.

In the exemplary embodiment according to FIG. 2, the data set DS34 which arrives at the diagnostic system 20 is a complete data set, meaning that said data set itself completely describes the set of points 34 and itself alone enables the subsequent diagnosis by the diagnostic system 20.

A receiving module DSEM which is stored in the memory 22 of the diagnostic system 20 will, when executed by the computing device 21, receive the data set DS34 and subsequently transmit it to the diagnostic module DM for the purpose of integration.

Figure 3:
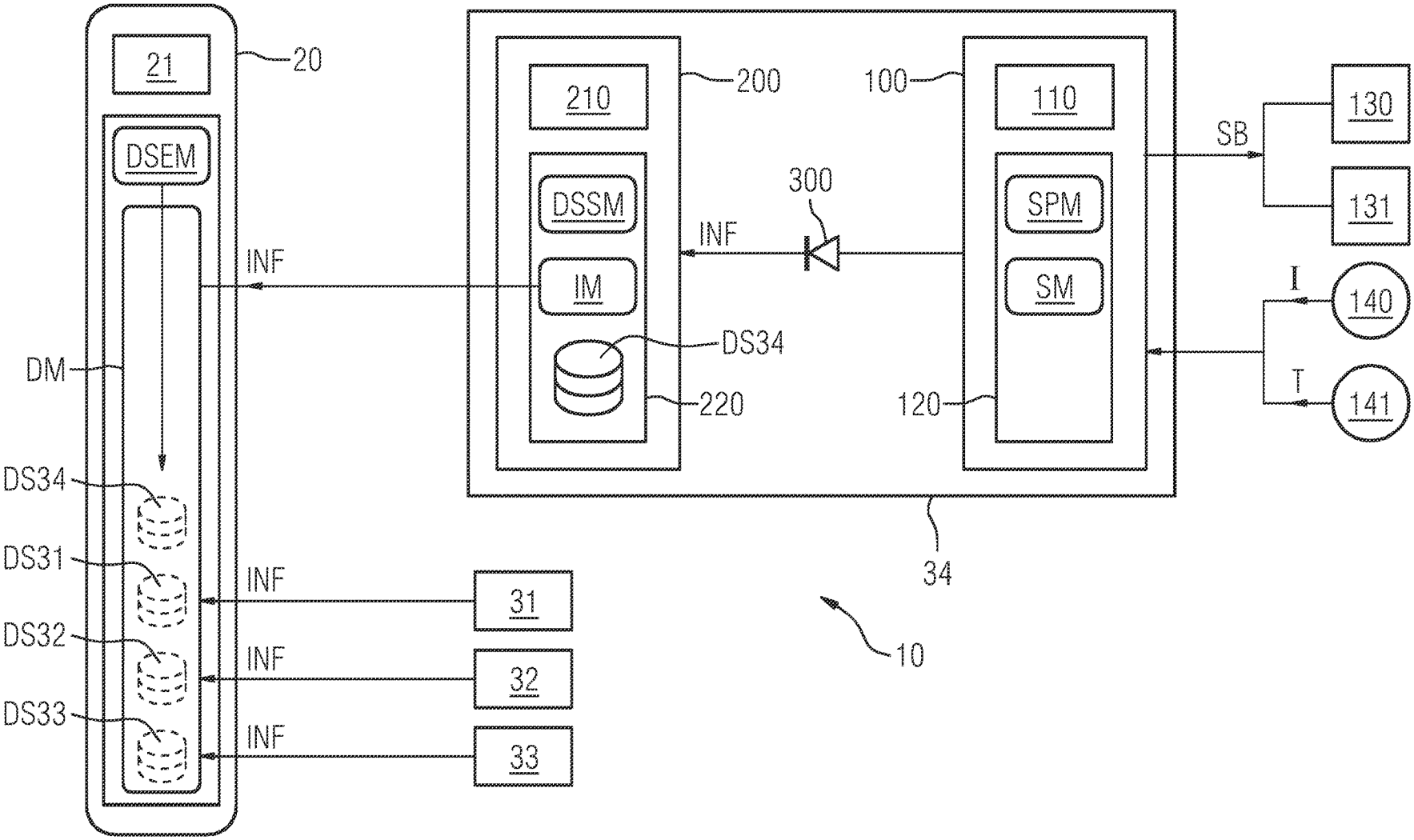
FIG. 3 shows the railway system according to FIG. 1 after completion of the plug-and-play reconfiguration and during the further diagnostic operation, which includes the newly connected railway component.

FIG. 3 shows the arrangement as per FIGS. 1 and 2 after the data set DS34 of the set of points 34 has been transmitted via the data set sending module DSSM and the receiving module DSEM and implemented by the diagnostic module DM.

Following such an implementation of the data set DS34, the diagnostic module DM can diagnose the set of points 34 on the basis of the information INF relating to the set of points 34.

The information INF, which is preferably based on the measurement results of the sensors 140 and 141, is transmitted from the data sending module SM of the first component part 100 via the data diode 300 to the second component part 200, and then from the information transfer module IM of the second component part 200 to the diagnostic system 20 or the diagnostic module DM thereof.

The diagnosis of the set of points 34 on the basis of the data set DS34 can take place in a conventional manner, for example, by evaluating the current values or current flows I that occur during operation of the set of points 34 and/or by monitoring throwing times T in respect of compliance with predetermined parameters or limit values when the set of points 34 is operated.

For example, if it can be identified that the current flow I is too high and/or the throwing time T is too long when the set of points 34 is operated, a degree of sluggishness of the set of points can be deduced and a corresponding maintenance order can be triggered to maintain the set of points 34.

This applies correspondingly to a diagnosis of the other railway components 31, 32 and 33. If the diagnostic system 20 or the diagnostic module DM thereof determines that the signal device 31 is not transmitting information INF, in the form of electrical signals, to indicate that it is operating correctly, a corresponding maintenance order can be triggered to replace parts of the signal device 31.

In the exemplary embodiment according to FIGS. 1 to 3, the railway components 31 to 34 which must be monitored or integrated into the diagnosis are directly connected to the diagnostic system 20.

Figure 4:
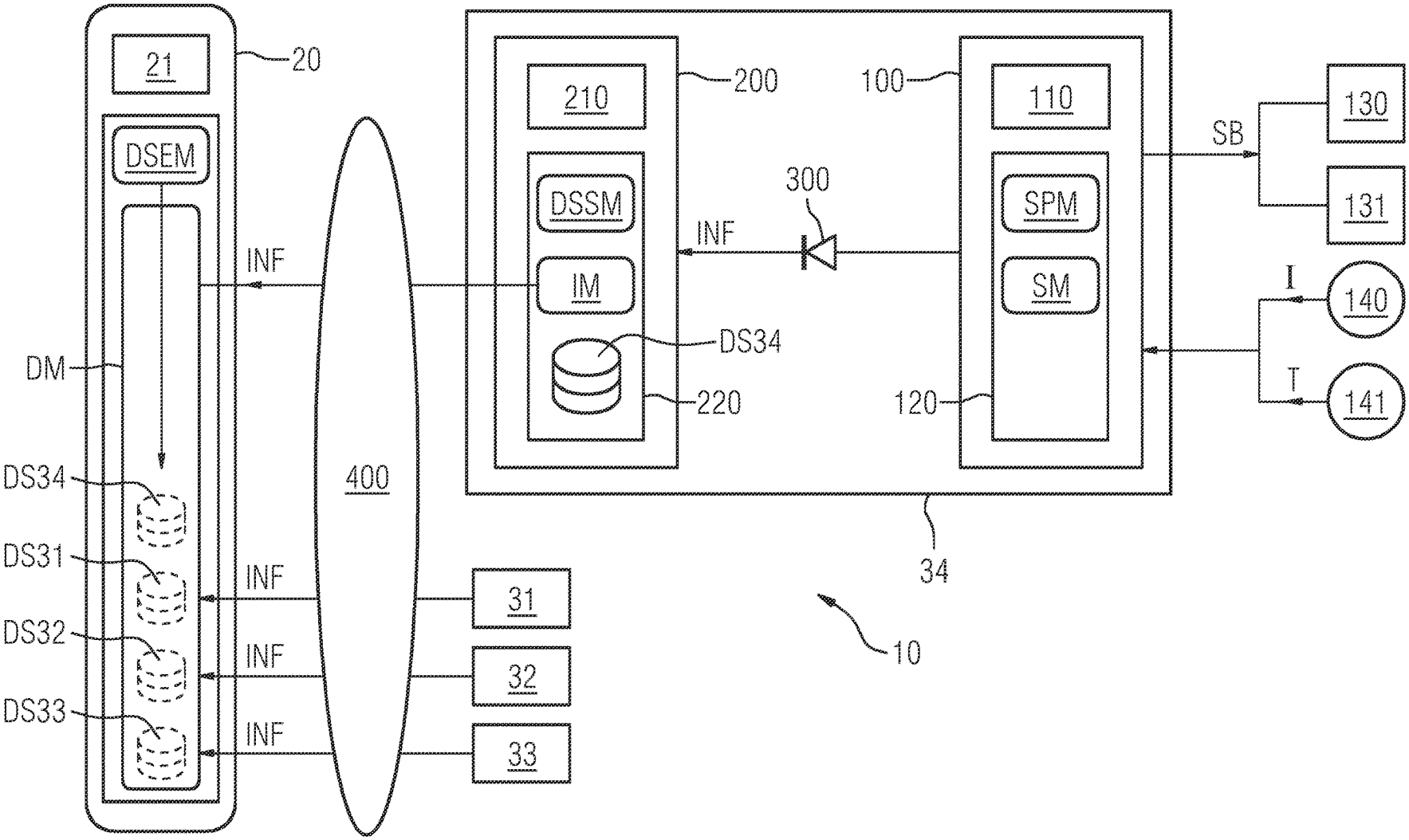
FIG. 4 shows an embodiment variant of the railway system according to FIGS. 1 to 3, into which an additional communication network has been integrated.

As shown in FIG. 4, it is alternatively possible to provide a connection between the components via a network, e.g., the internet. Such an embodiment is shown by way of example in FIG. 4, in which the railway components 31 to 34 are connected to the diagnostic system 20 via a communication network 400.

In other respects, the foregoing explanations concerning FIGS. 1 to 3 apply correspondingly to the arrangement shown in FIG. 4, particularly in relation to the functioning of the diagnostic system 20 and the functioning of the railway components 31 to 34 connected thereto.

Figure 5:
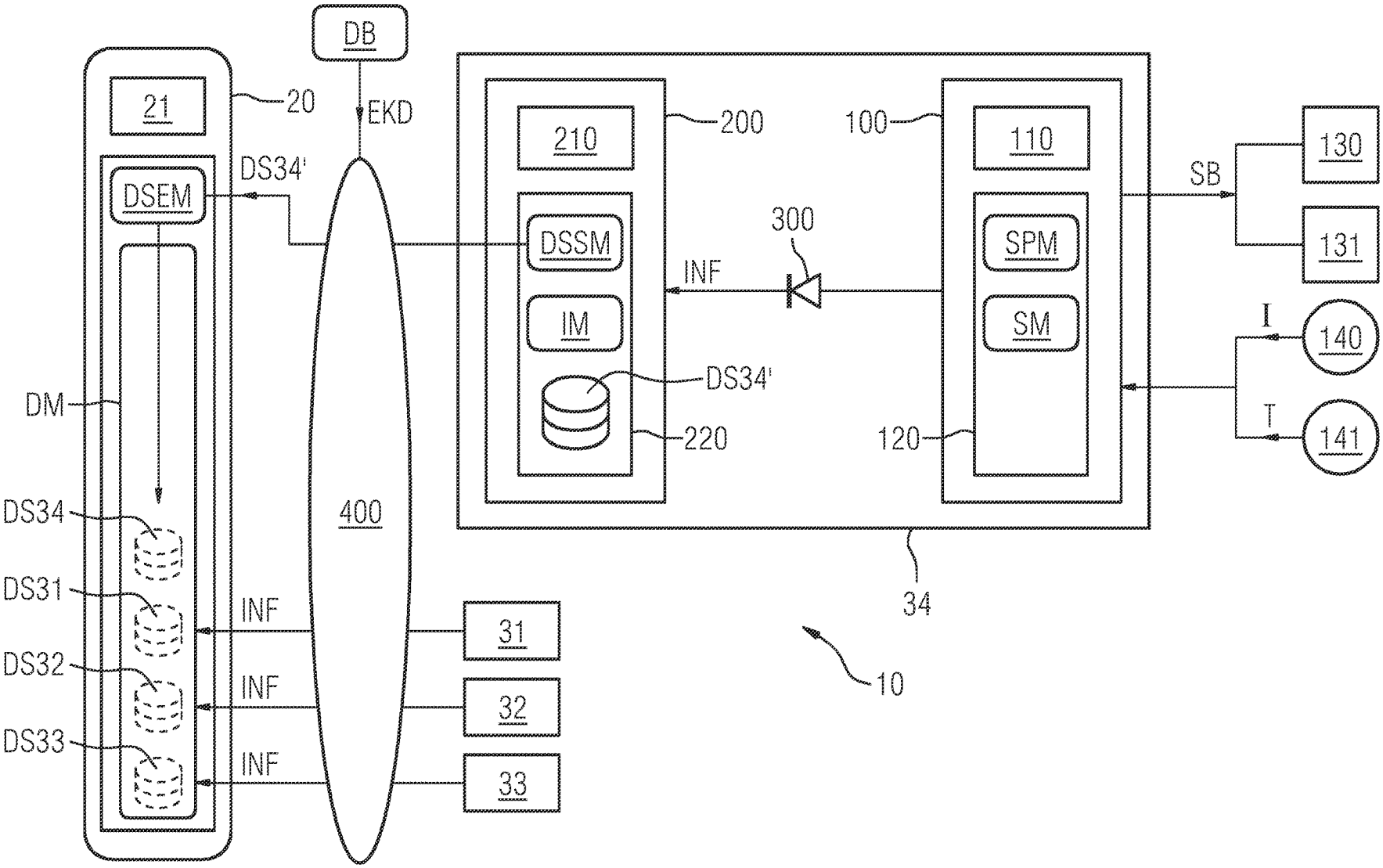
FIGS. 5-8 show exemplary embodiments for railway systems into which a new railway component without a not-safety-relevant component part has been integrated.

FIG. 5 shows an exemplary embodiment variant in which a data set DS34', which merely identifies the set of points 34, is transmitted to the diagnostic system 20.

In order to generate the complete data set DS34 which completely describes the set of points 34 and enables the subsequent diagnosis by the diagnostic system, the diagnostic system 20 will expand the received data set DS34', for example, by adding supplementary component data EKD from another source, for example a central database DB, which is connected to the diagnostic system 20 directly or indirectly via the communication network 400.

In other respects, the foregoing explanations concerning FIGS. 1 to 4 apply correspondingly to the arrangement shown in FIG. 5, particularly in relation to the functioning of the diagnostic system 20 and the functioning of the railway components 31 to 34 connected thereto.

Figure 6:
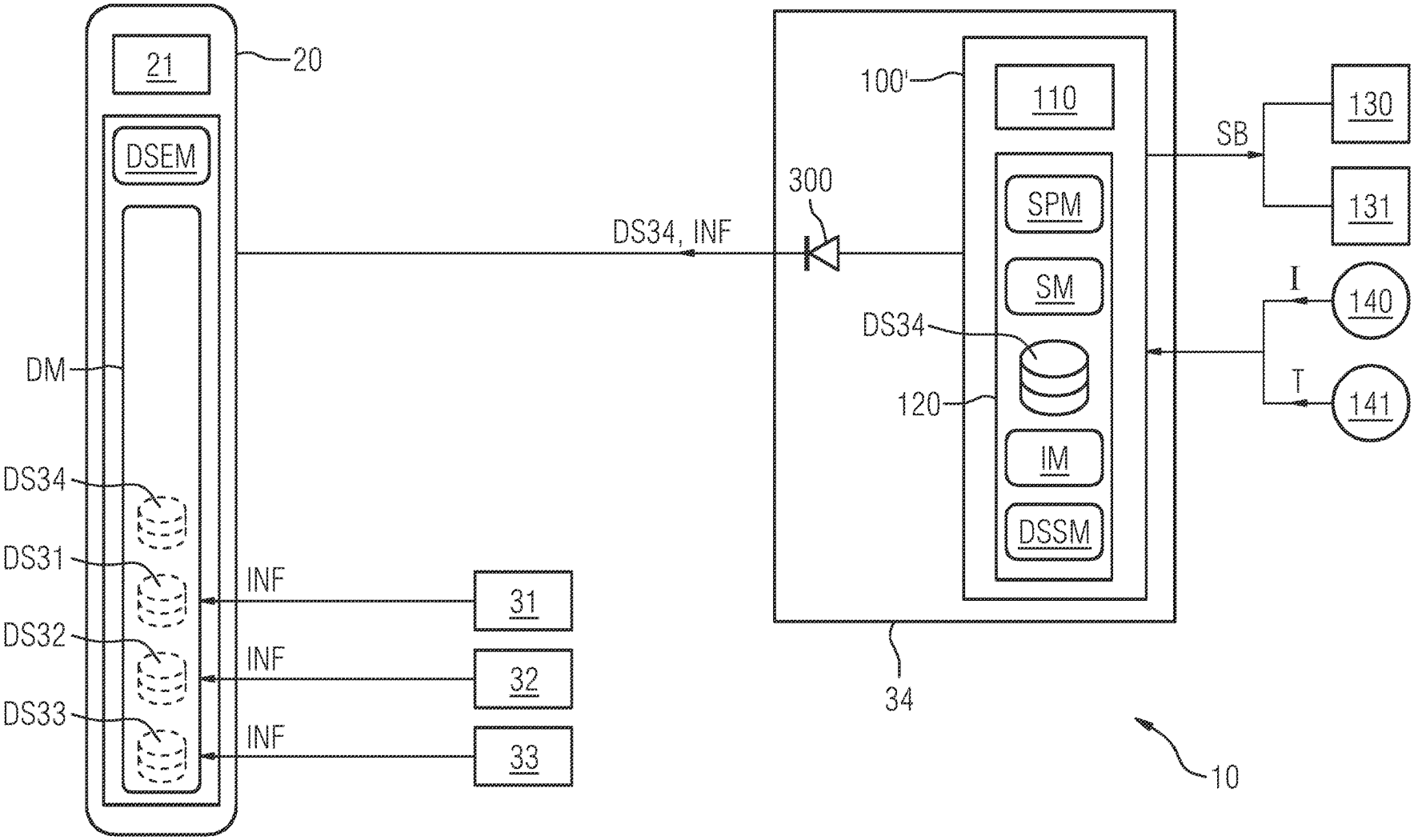

FIG. 6 shows a further exemplary embodiment of a railway component in the form of a set of points 34 which is connected to the diagnostic system 20 according to FIGS. 1 to 3.

Unlike the exemplary embodiment according to FIGS. 1 to 4, the set of points 34 according to FIG. 6 only comprises a safety-relevant component part 100', which meets or exceeds a predetermined safety standard such as the safety standard SIL 4, for example.

In the exemplary embodiment according to FIG. 6, the component part 100' corresponds to the first component part 100 according to FIGS. 1 to 4 with the difference that the data set sending module DSSM, the data set DS34 and the information transfer module IM are stored in the memory 120, and the data set DS34 arrives at the diagnostic system 20 from the information transfer module IM of the memory 120 via the data diode 300. Following connection to the diagnostic system 20, the component part 100' transfers the data set DS34 itself to the receiving module DSEM via the data diode 300 and then transfers the information INF itself to the diagnostic module DM of the diagnostic system 20.

Here again, the data diode 300 is used to reliably separate the set of points 34 or the safety-relevant component part 100' from the diagnostic system 20, and to prevent any access to the set of points 34 from outside.

In other respects, the foregoing explanations concerning FIGS. 1 to 4 apply correspondingly to the arrangement shown in FIG. 6, particularly in relation to the functioning of the diagnostic system 20 and the functioning of the railway components 31 to 34 connected thereto.

In the exemplary embodiment according to FIG. 6, the data diode 300 is directly connected to the diagnostic system 20. Alternatively, as shown in FIG. 7, it is also possible to connect a communication network 400 between them as explained above in relation to FIG. 4.

Figure 7:
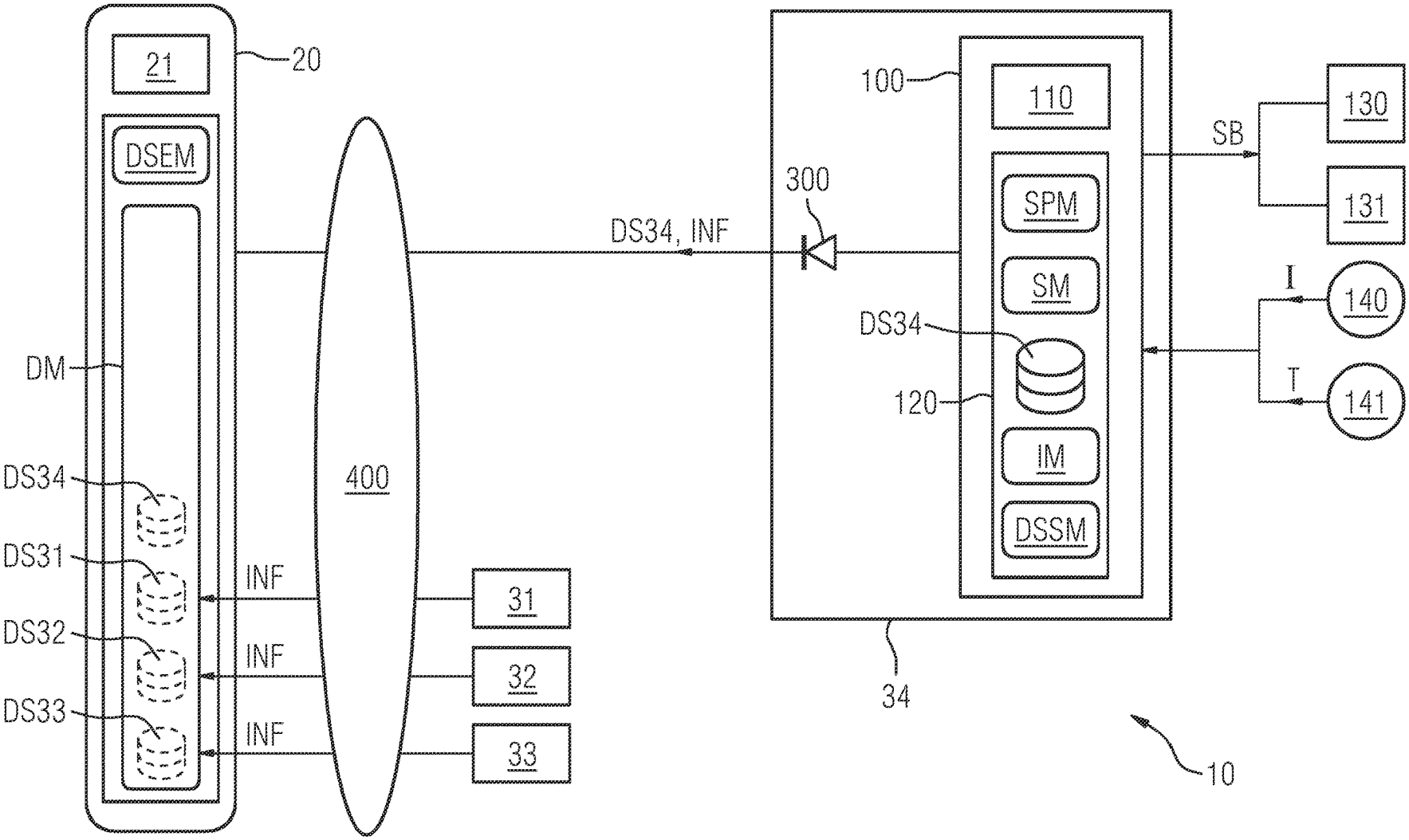

In other respects, the foregoing explanations concerning FIGS. 1 to 4 apply correspondingly to the arrangement shown in FIG. 7, particularly in relation to the functioning of the diagnostic system 20 and the functioning of the railway components 31 to 34 connected thereto.

Figure 8:
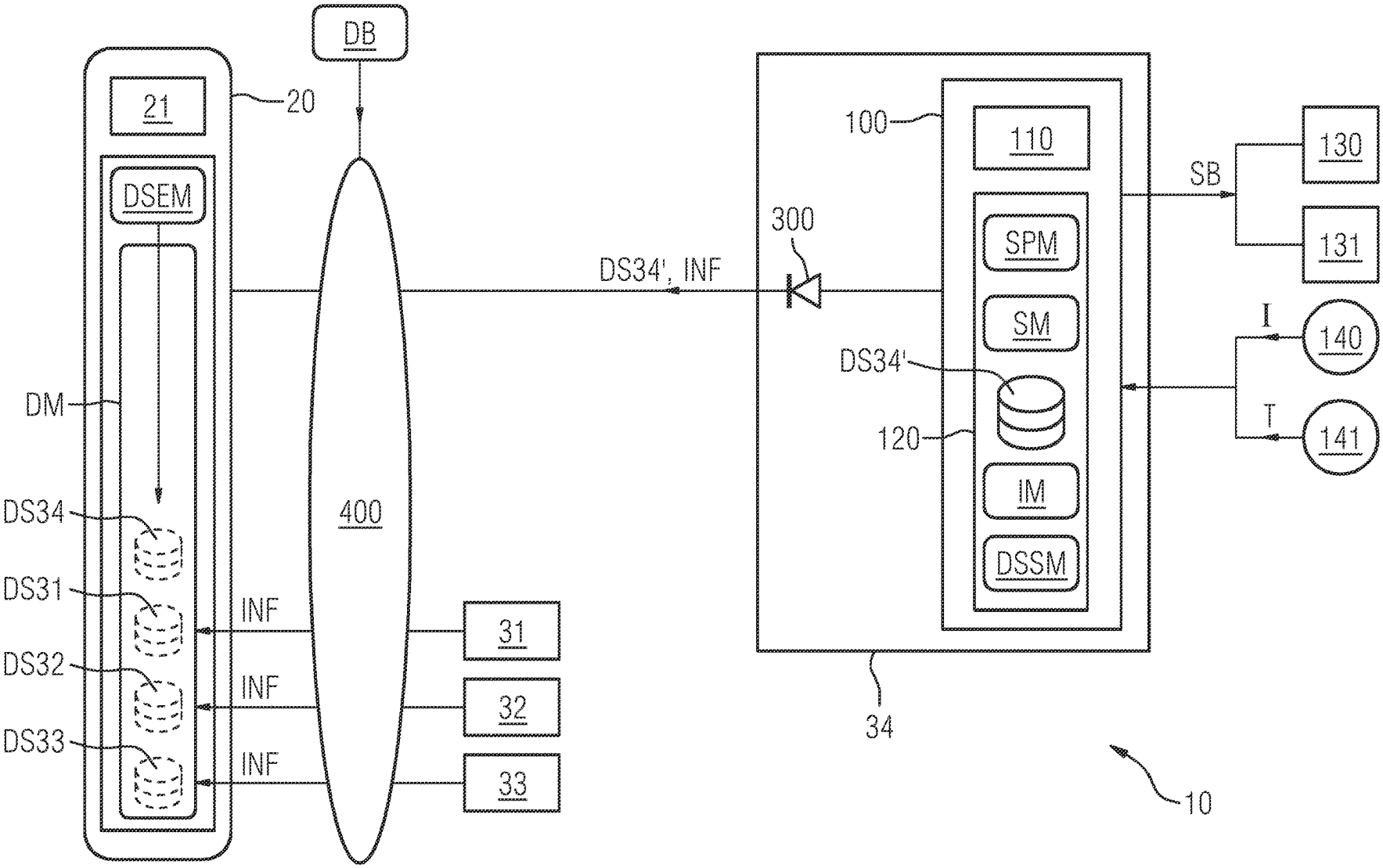

FIG. 8 shows an exemplary embodiment variant of the embodiment according to FIG. 7, in which a data set DS34' which merely identifies the set of points 34 is transmitted to the diagnostic system 20. The foregoing explanations concerning FIG. 5 apply here correspondingly.

In summary, the railway system 10 according to the FIGS. 1 to 8 can have one, a plurality of, or all of the advantages or features listed again below in the form of key points:

- The diagnostic system can be enabled to read out the required data from the components by means of a "just-in-time upgrade" (as soon as a new component is connected and becomes operational), such that project planning of the diagnostic system is no longer necessary.
- Components can log onto the diagnostic system and submit not only their own identifier but also their type configuration (the data model which replicates their diagnosis), as well as further information such as methods describing the diagnosis and data for language switching and symbols.
- The project planning data can be loaded directly into the railway components. As soon as a (new) railway component becomes operational in a railway system, said railway component logs onto the diagnostic system and the data set, which comprises both the data model of the diagnostic data and the methods describing the diagnosis of this component type, is transferred into the diagnostic system.
- The entities (actual individual railway components) no longer require project planning, but are generated "on-the-fly" in the diagnostic system.
- The project planning can be simplified, with costs being saved because project planning is not required for further entities. These are automatically generated in the diagnostic system as soon as the railway components log on (and deleted again if the railway components disappear).
- Railway components can be diagnosed as soon as they are connected to a railway system.
- Changes in the project planning data do not necessitate change effect analyses or regression tests, since no project planning data has to be changed.
- The railway components to be diagnosed can be both not-safety-relevant railway components (in the signaling sense) and safety-relevant railway components, which can be configured up to SIL 4.

The railway components can consist of at least one not-safety-relevant part, which can operate non-interactively in relation to the safety-relevant part (e.g. FM platform).

In the railway components, the not-safety-relevant part of the railway component can be used to store the following data: the diagnosis data model; customer-specific data such as e.g. languages and symbols; methods that can be applied for the purpose of fault analysis for this type of railway component; methods that can be applied for the purpose of fault analysis in connection with other component types.

The diagnostic system can optionally be designed as a cloud application.

The status data can be transmitted as before.

The diagnostic system or the cloud application which is implemented as a diagnostic system preferably has the ability to receive, store and therefore process the models and methods, as in the case of input via a conventional project planning system.

The diagnostic system preferably replicates the entity data automatically.

The upgrade preferably takes place during live operation. Likewise, in the case of a software update of the components, the data in the diagnostic system is preferably updated automatically such that data consistency is guaranteed at all times.

Although the invention is illustrated and described above in detail with reference to preferred exemplary embodiments, the invention is not limited by the examples disclosed and other variations can be derived therefrom by a person skilled in the art without departing from the scope of the invention.

LIST OF REFERENCE SIGNS

10 Railway system
20 Diagnostic system
21 Computing device
22 Memory
31 Signal device
32 Axle counter
33 Interlocking tower
34 Set of points
100 Component part
100' Component part
110 Computing device
120 Memory
130 Actuator
131 Further actuator
140 Sensor
141 Sensor
200 Component part
210 Computing device
220 Memory
300 Data diode
400 Communication network
DB Database
DM Diagnostic module
DS31 Data set
DS32 Data set
DS33 Data set
DS34 Data set
DS34' Data set
DSEM Receiving module
DSSM Data set sending module
EKD Supplementary component data
I Current value/current flow
IM Information transfer module
INF Information
SB Control command
SM Sending module
SPM Control program module
T Throwing time value

The invention claimed is:

1. A railway system, comprising:

a diagnostic system for monitoring railway components of the railway system; and at least one railway component connected to said diagnostic system;

said at least one railway component being configured, as part of a plug-and-play process following a connection to said diagnostic system, to autonomously transmit a self-describing data set or to allow said diagnostic system to request the data set, wherein the data set is a data set specific to the railway component and the data set by itself completely describes the railway component and the data set includes at least:

an unambiguous identification of the railway component;

a data structure of the information or diagnostic data of the railway component; and rules which could lead to a diagnostic result; and said diagnostic system being configured to receive the data set from the railway component and to integrate the railway component into a further diagnostic operation on a basis of the data set.

2. The railway system according to claim 1, wherein said diagnostic system is configured to receive the data set from said at least one railway component, and to integrate said at least one railway component into the further diagnostic operation, while live diagnostic operation is taking place in relation to other railway components.

3. The railway system according to claim 1, wherein said at least one railway component has a first component part which meets or exceeds a predetermined safety standard, and a second component part which does not meet the predetermined safety standard; and the data set is stored in said second component part.

4. The railway system according to claim 3, wherein said second component part is configured to autonomously transmit the data set to said diagnostic system following connection to said diagnostic system.

5. The railway system according to claim 3, wherein said second component part is configured to enable said diagnostic system to request the data set following connection to said diagnostic system.

6. The railway system according to claim 3, wherein:

said first and second component parts are connected via a data diode which allows a data flow exclusively from said first component part to said second component part; and wherein information relating to said first component part, which must be transmitted to said diagnostic system for a diagnostic purpose, is transferred via the data diode to said second component part and from said second component part to said diagnostic system.

7. The railway system according to claim 1, wherein:

said railway component is connected to said diagnostic system via a data diode which allows a data flow exclusively from said railway component to said diagnostic system; and said railway component is configured, following connection to said diagnostic system, to autonomously transmit the data set and subsequently information which must be transmitted to the diagnostic system for diagnostic purposes, via the data diode to said diagnostic system as part of the plug-and-play process.

8. The railway system according to claim 1, wherein at least one of the following is true:

said at least one railway component is a railroad switch configured to transmit, as information that must be transmitted to the diagnostic system for diagnostic purposes, at least one of current values or switch throwing times to the diagnostic system;

said at least one railway component is a signal device configured to transmit, as information that must be transmitted to the diagnostic system for diagnostic purposes, current values to the diagnostic system;

said at least one railway component is an interlocking tower configured to transmit, as information that must be transmitted to the diagnostic system for diagnostic purposes, interlocking tower data to the diagnostic system;

said at least one railway component is a rail control center configured to transmit, as information that must be transmitted to the diagnostic system for diagnostic purposes, control center data to the diagnostic system; or said at least one railway component is an axle counter configured to transmit, as information that must be transmitted to the diagnostic system for diagnostic purposes, axle counter data to the diagnostic system.

9. The railway system according to claim 1, wherein said at least one rail component is further configured to autonomously transmit a self-describing data set to said diagnostic system of the railway system following a connection to the diagnostic system of the railway system.

10. The railway system according to claim 9, comprising a computing device that is programmed in software or in hardware to autonomously transmit the self-describing data set to said diagnostic system following the connection to said diagnostic system of the railway system.

11. The railway system according to claim 1, wherein said diagnostic system is further configured to receive a data set from a railway component that is newly connected to the diagnostic system and to integrate the railway component into a further diagnostic operation on a basis of the data set.

12. The diagnostic system according to claim 11, comprising a computing device that is programmed in software or in hardware to receive the data set from the railway component that is newly connected to the diagnostic system and to integrate the railway component into a further diagnostic operation on a basis of the data set.

13. The railway system according to claim 1, wherein the data set received from the railway component comprises further component-specific information, including alarm reports in different languages or symbols which graphically represent the railway component.

14. A method for operating a railway system which has a diagnostic system for monitoring railway components of the railway system, the method comprising:

following a connection of a railway component to the diagnostic system, autonomously transmitting with the railway component a self-describing data set and/or allowing the diagnostic system to request a self-describing data set as a part of a plug-and-play process, wherein the data set is a data set specific to the railway component, the data set by itself completely describes the railway component, and the data set includes at least:

an unambiguous identification of the railway component;

a data structure of the information or diagnostic data of the railway component; and rules which could lead to a diagnostic result; and receiving the data set by the diagnostic system from the railway component and integrating the railway component into a further diagnostic operation based on the data set.

15. The method according to claim 14, wherein the data set which arrives at the diagnostic system as part of the plug-and-play process following connection to the diagnostic system is a complete data set which itself completely describes the railway component and itself alone enables the subsequent diagnosis by the diagnostic system.

16. The method according to claim 14, wherein the data set which arrives at the diagnostic system is a complete data set which completely describes the railway component and which enables a subsequent diagnosis by the diagnostic system.

* * * * *